US005134807A

United States Patent [19]

Keefe

[11] Patent Number: 5,134,807

[45] Date of Patent: Aug. 4, 1992

[54] MULTILEVEL GRINDING APPARATUS

[75] Inventor: James V. Keefe, Park Ridge, Ill.

[73] Assignee: Speedfam Corporation, Des Plaines, Ill.

[21] Appl. No.: 923,669

[22] Filed: Oct. 27, 1986

[51] Int. Cl.[5] ..... B24B 7/00

[52] U.S. Cl. ..... 51/109 R; 51/110; 51/209 R

[58] Field of Search ..... 51/109 R, 110, 209 R, 51/3, 5 D; 125/5, 9

[56] References Cited

U.S. PATENT DOCUMENTS 3,805,456 4/1974 Williams ..... 51/110

FOREIGN PATENT DOCUMENTS 0672005 7/1979 U.S.S.R. ..... 51/109 R

*Primary Examiner*—Bruce M. Kisliuk
*Assistant Examiner*—Lawrence Cruz
*Attorney, Agent, or Firm*—Allegretti & Witcoff, Ltd.

[57] ABSTRACT

A grinding apparatus comprises first and second grinding wheels for grinding the arms of E-cores, or any other desired item, having two different lengths, in a single grinding operation.

3 Claims, 2 Drawing Sheets

MULTILEVEL GRINDING APPARATUS

BACKGROUND OF THE INVENTION

In the electrical or electronics industry, there is great use of ferrite "E-cores" for use as magnets in various wound core assemblies. In order to assure proper magnetic flow, it is necessary for the faces of the E-cores to be extremely flat, and with relatively good surface smoothness, so that a constant, smooth flow is provided to the magnetic path. This requires an operation after firing of the ferrite to provide the flat, smooth surfaces. Machines for accomplishing this are sold by Speedfam Corporation of Des Plaines, Ill., for example the Through-Feed Grinder.

Hitherto, ground E-cores have been provided with the two outer arms and the central arm being all of substantially the same length.

In some products, there is a need for the center leg of E-cores to be shorter than the two outer legs to provide an air gap between two mated coils. Difficulties exist in the production of such a design of E-core, where the middle arm is generally 0.002 to 0.04 inch shorter than the outer arms. Generally, a separate grinding step for the middle arm is required, which results in a significant increase in the cost of manufacturing E-cores of that design.

In accordance with this invention, a grinding apparatus is disclosed, modified to grind items, and specifically E-cores, in more than one plane, so that first and second ground areas on the product may be in different planes. The grinding procedure may be performed in a single operation, without need to mount the items to be ground into two different machines in two different productions. Thus, a considerable saving in manufacturing costs can be achieved, while at the same time improved accuracy of grinding can be obtained since the two planes of grinding may be well correlated with each other.

Not only is the apparatus of this invention contemplated for the grinding E-cores, but any desired workpiece may be ground in the apparatus of this invention, for single step grinding in two or more planes.

DESCRIPTION OF THE INVENTION

In accordance with this invention grinding apparatus is provided which comprises a first grinding wheel, and means for presenting a workpiece for grinding to said first grinding wheel.

By this invention a second grinding wheel is provided, carried with the first grinding wheel and positioned so that the presenting means can also present a portion of the workpiece to said second grinding wheel for grinding. The first wheel (i.e., its grinding surface) is rotatable in a first plane, while the grinding surface of the second wheel is rotatable in a plane different from the first plane.

As a result of this, the portion of the workpiece ground by the second wheel is ground to a different plane from other workpiece portions which are ground by the first grinding wheel.

Typically, the first and second grinding wheels are in coaxial relation with each other. In fact, a standard Through-Feed grinder, manufactured by the Swiss company Famtec, may be used as a basic grinding apparatus, to be modified in accordance with this invention by providing the second grinding wheel, typically inside of the first grinding wheel, about the center of rotation of the first grinding wheel.

Additionally, the means for presenting the workpiece for grinding may constitute guide track means for carrying the workpiece across said first and second grinding wheels in a diametric or chordal path. Specifically, the track means may be proportioned for moving E-cores first across the first grinding wheel in a position to grind at least the ends of the outer arms of the E-cores, followed by moving the E-cores across the second grinding wheel in a position to grind only the end of the central arm. Typically, the central arm will be ground by the first grinding wheel also. Following this, only the central arm is ground by the second grinding wheel, which has its grinding surface positioned approximately 0.002 to 0.04 inch above the grinding surface of the first grinding wheel.

Typically, the second grinding wheel is of less diameter at its grinding surface than the distance between each pair of outer arms of the E-core, so that the outer arms do not engage the second grinding wheel.

The first grinding wheel, and also the second grinding wheel, if desired, may define an inner rim that is higher than its outer rim. As a result of this, parts traveling on a chordal or diametric path across the grinding wheels may have their final sizing controlled by the position of the inner rim, while rougher grinding takes place on the outer portions of the grinding wheels.

The invention may be used with any other desired type of grinder as well, e.g. vertical spindle grinders with either a rotary or a reciprocating table, with parts traveling on a curved path across the grinding wheels.

DESCRIPTION OF SPECIFIC EMBODIMENT

Figure 1:
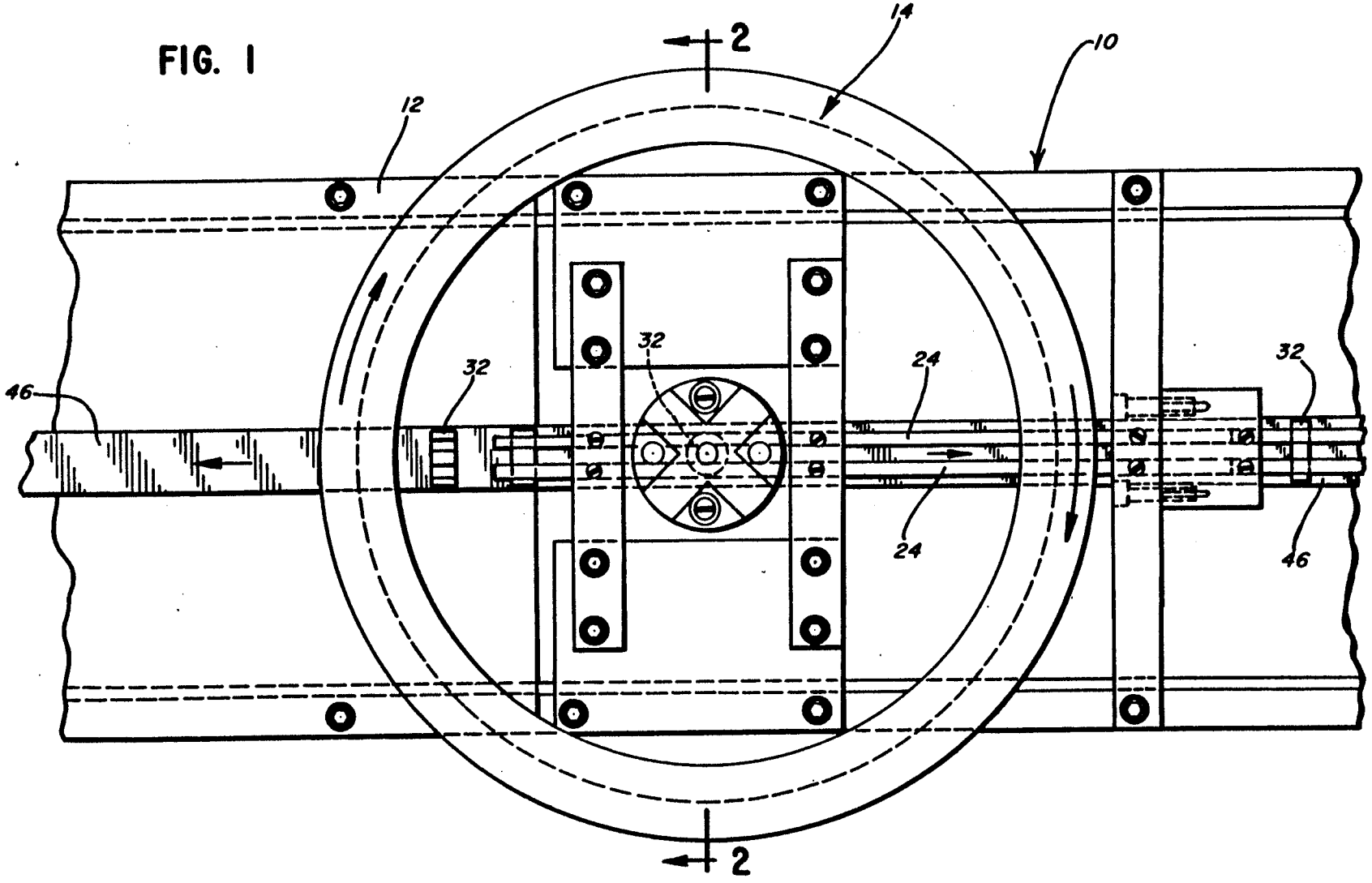
FIG. 1 is a plan view of the grinding apparatus of this invention.

Referring to the drawings, grinding apparatus 10 is disclosed, of conventional design, except as otherwise shown herein Frame 12 carries a first grinding wheel 14, bolted to backing plate 16, and of generally conventional design. For example, grinding wheel 14 may be a standard 10 inch diamond grinding wheel, with the grinding surface 18 being a diamond abrasive surface, and shown as in FIG. 2 to have an inner rim 20 that is higher than its outer rim 22. The term "higher" in this special context still applies even though grinding wheel 14, carried on annular support 15, is inverted. In other words, the term "higher" is essentially synonymous with—outwardly projecting—relative to the workpiece. A two bar guide track 24 is disclosed, along which E-core workpieces 32 may pass, with each bar of guide track 24 resting between the respective outer arms 28 and central arm 30 of E-core 32. However, other designs of guide systems may also be used.

Figure 2:
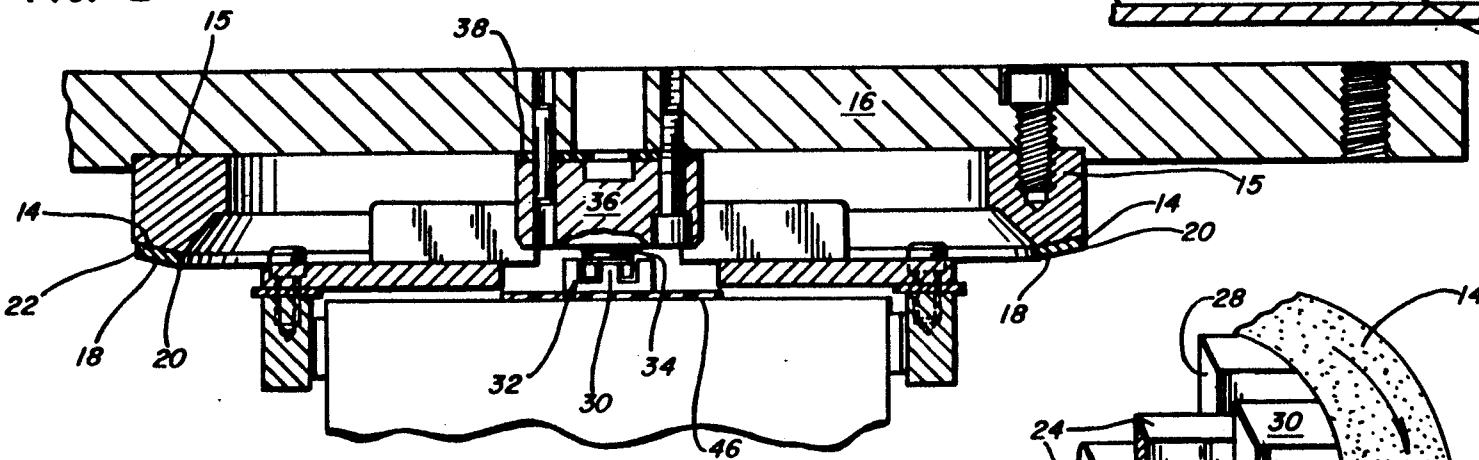
FIG. 2 is a sectional view taken along line 2—2 of FIG. 1.

In accordance with this invention, second grinding wheel 34 is provided, being carried by a support member 36, which is bolted to backing wheel 16 as shown in FIG. 2. Backing member 36 may be shimmed by shims 38 to cause second grinding wheel 34 to occupy a plane different from the plane occupied by grinding surface 18 of first grinding ring 14. Otherwise, adjusting screws or the like may be used. Specifically, this can be shown by the difference between edge line 40 which defines the level of the inner rim edge 20 of first grinding ring 14, and edge line 42, which defines the level of the inner portion of second grinding ring 34. The gap of typically 0.002 to 0.04 inch, but actually any desired gap, can be seen by comparison of lines 40, 42. If desired, second grinding ring 34 may be tapered so that its inner portion stands out farther than its outer portions. If desired, the outer portions of second ring 34 may have a level that overlaps the plane of first grinding ring 14, although it is common to adjust the system so that no overlapping of levels is provided.

Accordingly, E-cores 32 are moved along guide track 24, carried by high friction belt 46 positioned underneath guide track 24. Friction belt 46 advances the E-core, with their respective arms pointing upwardly, while the individual tracks of guide track 24 are optionally present to keep the E-core in position as it is moved along high friction belt 46.

Figure 3:
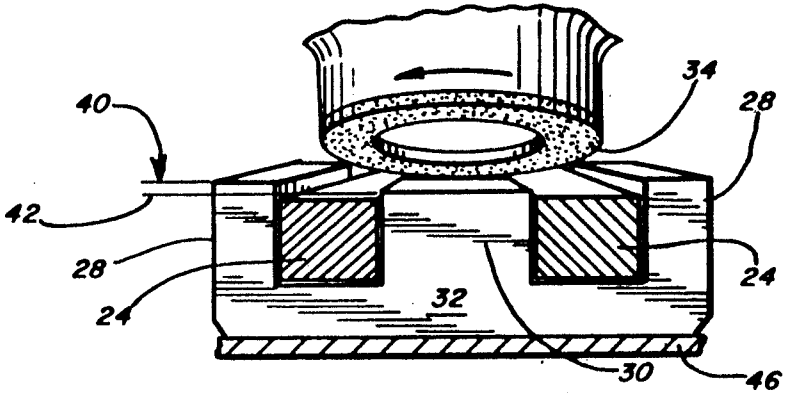
FIG. 3 is an elevational view of an E-core manufactured in accordance with this invention showing the second grinding ring or wheel in exploded relation.
Figure 4:
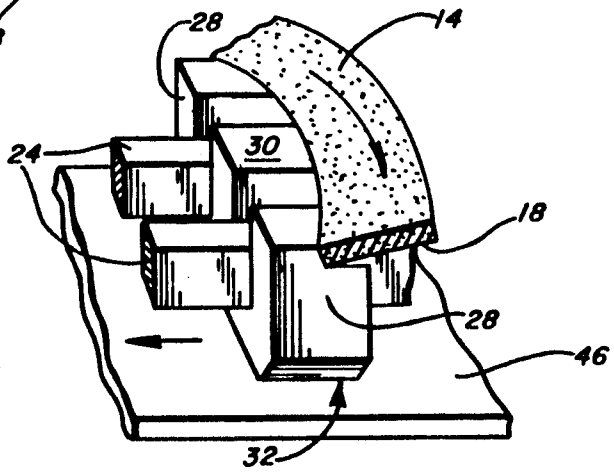
FIG. 4 is an enlarged, fragmentary, perspective view of the first grinding wheel in action.

Belt 46 brings E-cores 32 one by one into contact with first grinding wheel 14, at which point at least the outer arms 28 of E-cores 32 are ground to the desired length and texture, depending particularly upon the positioning of inner portion 20 of the first grinding ring. Following this, high friction belt 46 causes the E-cores 32 to be advanced along rails 24 to bring central arm 30 across grinding wheel 34, in typically a diametric path as shown for both the first and second grinding wheels. Since second grinding wheel 34 is too small to engage outer arms 28 of the E-core, and since second grinding wheel 34 is in an advanced plane different from the plane of first grinding wheel 18, central arm 30 of each E-core 32 is ground slightly shorter than the outer arms 28, as shown in possibly exaggerated proportions in FIG. 3. Following this, E-cores 32 may continue along belt 46 to be picked off or dropped in any conventional manner for shipping or further processing.

Accordingly, E-cores or any other desired workpiece may be ground in two or more separate planes in a single manufacturing step, for a significant increase in manufacturing efficiency, and a reduction in cost. Also, the accuracy in grinding can be increased, because the two (or more if desired) grinding wheels are carried together on a single apparatus, and thus may be precisely positioned relative to each other, with less possibility of getting out of adjustment.

The above has been offered for illustrative purposes only, and is not intended to limit the scope of the invention, which is as defined in the claims below.

That which is claimed is:

1. In grinding apparatus which comprises a first grinding wheel, and means for presenting a workpiece for grinding to said first grinding wheel, the improvement comprising, in combination:

a second grinding wheel carried with and in coaxial relation with said first grinding wheel and positioned so that said presenting means can also present a portion of said workpiece to said second grinding wheel for grinding, said first wheel being rotatable in a first plane, said second wheel being rotatable in a plane different from said first plane, said first grinding wheel defining an inner rim that is higher than its outer rim, whereby final sizing of parts ground thereon can be performed by said inner rim, said presenting means including conveyor belt means provided for moving E-cores, having a central arm and a pair of outer arms, first across said first grinding wheel in a position to grind at least the ends of said outer arms, and then moving said E-cores across said second grinding wheel in a position to grind only the end of said central arm, said second grinding wheel being of less diameter at its grinding surface than the distance between each of said pair of outer arms of the E-cores, whereby said portion of the workpiece ground by the second grinding wheel is ground to a different plane from other workpiece portions ground by the first grinding wheel.

2. In grinding apparatus which comprises a first grinding wheel, and means for presenting a workpiece for grinding to said first grinding wheel, the improvement comprising, in combination: a second grinding wheel carried with said first grinding wheel, said second grinding wheel being coaxially positioned with respect to said first grinding wheel so that said presenting means can also present a portion of said workpiece to said second grinding wheel for grinding, said first wheel being rotatable in a first plane, said second wheel being rotatable in a plane different from said first plane, said first grinding wheel defining an inner rim that is higher than its outer rim, whereby final sizing of parts ground thereon can be performed by said inner rim, said presenting means including guide track means provided for moving E-cores, having a central arm and a pair of outer arms, first across said first grinding wheel in a position to grind at least the ends of said outer arms and then for moving said E-cores across said second grinding wheel in a position to grind only the end of said central arm, said second grinding wheel being of less diameter at its grinding surface than the distance between each pair of outer arms, said presenting means carrying said workpiece across said first and second grinding wheels in a diametric of chordal path, whereby said portion of the workpiece ground by the second wheel is ground to a different plane from other portions ground by the first grinding wheel.

3. In grinding apparatus which comprises a first grinding wheel, and means for presenting a workpiece for grinding to said first grinding wheel, the improvement comprising, in combination:

a second grinding wheel carried with said first grinding wheel, said second grinding wheel being coaxially positioned with respect to said first grinding wheel so that said presenting means can also present a portion of said workpiece to said second grinding wheel for grinding, said first wheel being rotatable in a first plane, said second wheel being rotatable in a plane different from said first plane, said presenting means carrying said workpiece across said first and second grinding wheels in a diametric or chordal path, whereby said portion of the workpiece ground by the second wheel is ground to a different plane from other workpiece portions ground by the first grinding wheel, and said first grinding wheel defines an inner rim that is higher than its outer rim, whereby final sizing of parts ground thereon can be performed by said inner rim.

* * * * *